US010768555B1

(12) United States Patent
Ogishima et al.

(10) Patent No.: US 10,768,555 B1
(45) Date of Patent: Sep. 8, 2020

(54) CLEANING DEVICE

(71) Applicant: FUJI XEROX CO., LTD., Tokyo (JP)

(72) Inventors: Kazuya Ogishima, Kanagawa (JP); Akira Shimodaira, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/511,694

(22) Filed: Jul. 15, 2019

(30) Foreign Application Priority Data

Feb. 20, 2019 (JP) ..... 2019-028082

(51) Int. Cl.
*G03G 15/16* (2006.01)

(52) U.S. Cl.
CPC ..... *G03G 15/161* (2013.01); *G03G 15/168* (2013.01)

(58) Field of Classification Search
CPC ..... G03G 15/161; G03G 15/168; G03G 15/0131; G03G 21/0011; G03G 21/0029
See application file for complete search history.

(56) References Cited

U.S. PATENT DOCUMENTS 8,503,903 B2 * 8/2013 Yamada ..... G03G 15/0131 399/101
9,885,982 B2 2/2018 Kojiri et al.
10,095,162 B2 10/2018 Katahira et al.

FOREIGN PATENT DOCUMENTS

JP 2017-126033 A 7/2017
JP 2018-025643 A 2/2018

* cited by examiner

*Primary Examiner* — Hoang X Ngo
(74) *Attorney, Agent, or Firm* — Sughrue Mion, PLLC

(57) ABSTRACT

A cleaning device includes a scraping portion whose edge is pressed against a rotational body to which toner adheres and that scrapes the toner off the rotational body, and a container that contains the toner that has been scraped off the rotational body. The container has a through-hole that opens in a portion of the container facing the scraping portion and that allows a gas to flow from an inside of the container toward the scraping portion.

15 Claims, 8 Drawing Sheets

CLEANING DEVICE

CROSS-REFERENCE TO RELATED APPLICATIONS

This application is based on and claims priority under 35 USC 119 from Japanese Patent Application No. 2019-028082 filed Feb. 20, 2019.

BACKGROUND

(i) Technical Field

The present disclosure relates to a cleaning device.

(ii) Related Art

Japanese Unexamined Patent Application Publication No. 2017-126033 describes a transfer device that includes a second-transfer roller. The second-transfer roller includes an elastic layer and a surface layer that is closely attached to the outside of the elastic layer. The second-transfer roller rotates and transfers a toner image from a surface of an intermediate transfer belt to a recording medium. The transfer device further includes a cleaning member and a pressing member. The cleaning member is in contact with the second-transfer roller and scrapes off substances adhering to the surface layer. The pressing member is pressed against the surface layer at a position downstream of a position where the intermediate transfer belt contacts the second-transfer roller and upstream of the cleaning member in the rotation direction of the second-transfer roller. The pressing member rotates in the same direction as the second-transfer roller.

Japanese Unexamined Patent Application Publication No. 2018-25643 describes a cleaning device that includes a first cleaning plate and a second cleaning plate. The first cleaning plate performs cleaning by causing a free end thereof to contact an outer peripheral surface of a cylindrical second-transfer rotational body, which has an elastic layer, in such a way that the outer peripheral surface elastically deforms. The second cleaning plate performs cleaning by causing a free end thereof to contact a portion of the outer peripheral surface of the second-transfer rotational body. The portion is located downstream, in the rotation direction of the second-transfer rotational body, of a position where the free end of the first cleaning plate contacts. The portion elastically deforms in such a way that the curvature of a surface thereof becomes smaller than those of other portions due to contact of the free end of the first cleaning plate.

SUMMARY

A structure including a scraping portion whose edge is pressed against a rotational body to which toner adheres and that scrapes the toner off the rotational body is known. With such a structure, the toner may be melted by frictional heat that is generated between the edge of the scraping portion and the rotational body, and the toner may firmly adhere to the edge of the scraper and the like.

Aspects of non-limiting embodiments of the present disclosure relate to reducing firm adhesion of toner to a scraping portion due to generation of frictional heat, compared with a case where a container is tightly closed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, a cleaning device includes a scraping portion whose edge is pressed against a rotational body to which toner adheres and that scrapes the toner off the rotational body, and a container that contains the toner that has been scraped off the rotational body. The container has a through-hole that opens in a portion of the container facing the scraping portion and that allows a gas to flow from an inside of the container toward the scraping portion.

BRIEF DESCRIPTION OF THE DRAWINGS

An exemplary embodiment of the present disclosure will be described in detail based on the following figures, wherein.

DETAILED DESCRIPTION

Hereafter, an exemplary embodiment of the present disclosure will be described with reference to the drawings.

Image Forming Apparatus 100

Figure 1:
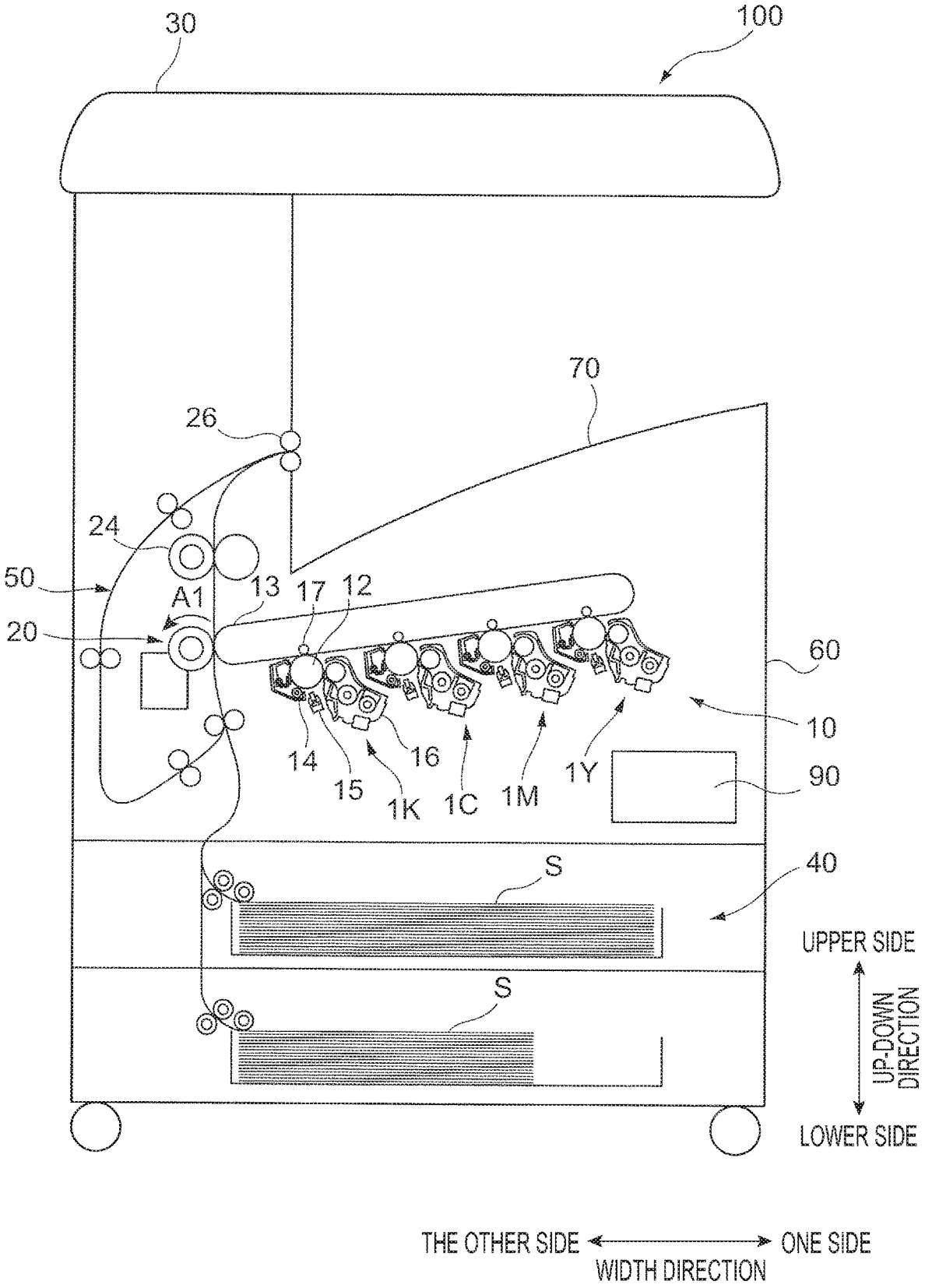
FIG. 1 is a schematic view of an image forming apparatus according to the exemplary embodiment.

FIG. 1 is a schematic view of an image forming apparatus 100 according to the present exemplary embodiment. The image forming apparatus 100 illustrated in FIG. 1 is a tandem color printer. The image forming apparatus 100 includes the following: an image forming section 10 that forms images corresponding to image data items for respective colors; an image scanner 30 that scans an image of a document; a sheet feeder 40 that supplies a sheet S to the image forming section 10; a transport section 50 that transports the sheet S when the image forming apparatus 100 performs duplex printing to form images on both sides of the sheet S; and a controller 90 that controls the operation of the entirety of the image forming apparatus 100.

The constituent elements of the image forming apparatus 100 are contained in a casing 60. A stacker 70 is disposed at an upper surface of the casing 60 below the image scanner 30. Sheets S on which images have been formed by the image forming section 10 are stacked on the stacker 70.

Image Forming Section 10

The image forming section 10 includes four image forming units 1Y, 1M, 1C, and 1K that are arranged side by side at regular intervals. Each of the image forming units 1Y, 1M, 1C, and 1K forms a toner image by using an electrophotographic method. The image forming units 1Y, 1M, 1C, and 1K have the same structure, except that toners contained in developing devices 16 (described below) differ from each other. The image forming units 1Y, 1M, 1C, and 1K respectively form yellow (Y), magenta (M), cyan (C), and black (K) toner images.

The image forming section 10 includes an intermediate transfer belt 13 to which the color toner images formed on photoconductor drums 12 of the image forming units 1 are transferred. The image forming section 10 includes first-transfer rollers 17 that successively transfer (first-transfer) the color toner images formed by the image forming units 1 to the intermediate transfer belt 13. The image forming section 10 further includes a second-transfer device 20 that simultaneously transfers (second-transfers) the color toner images that overlap on the intermediate transfer belt 13 to the sheet S, a fixing device 24 that fixes the second-transferred color toner images to the sheet S, and an output roller 26 that outputs the sheet S.

Image Forming Unit 1

Each of the image forming units 1 includes the photoconductor drum 12 that holds a toner image, a charging device 14 that charges the photoconductor drum 12, an exposure device 15 that exposes the surface of the charged photoconductor drum 12 to form an electrostatic latent image, and the developing device 16 that develops the electrostatic latent image on the photoconductor drum 12 to form a toner image. In the developing device 16, a two-component developer, which includes a magnetic carrier and a toner having a predetermined color, is used.

Image Forming Process

The image forming apparatus 100 performs an image forming process under the control by the controller 90. That is, image data is obtained from a PC (not shown) or the image scanner 30, an image processor (not shown) processes the image data to generate image data items for respective colors, and the image data items are sent to the exposure devices 15 of the image forming units 1. The exposure devices 15 perform exposure and the developing devices 16 perform development, thereby forming toner images on the photoconductor drums 12.

The first-transfer rollers 17 successively first-transfer the color toner images formed on the photoconductor drums 12 of the image forming units 1 to the intermediate transfer belt 13, thereby forming an overlapping toner image in which the color toner images overlap. The overlapping toner image is transported toward the second-transfer device 20 as the intermediate transfer belt 13 moves.

A sheet S is supplied from the sheet feeder 40 and is transported to the second-transfer device 20 with a timing corresponding to the timing with which the overlapping toner image on the intermediate transfer belt 13 is transported to the second-transfer device 20. The second-transfer device 20 second-transfers the overlapping toner image from the intermediate transfer belt 13 to the sheet S. The fixing device 24 fixes the overlapping toner image, which has been transferred to the sheet S, to the sheet S. The output roller 26 outputs the sheet S to the stacker 70. When the image forming apparatus 100 performs duplex printing, the transport section 50 transports the sheet S, on a front surface (first surface) of which a fixed image has been formed through the process described above, again to the second-transfer device 20, and a fixed image is formed on a back surface (second surface) of the sheet S.

The temperature of the second-transfer device 20 easily increases because of the position thereof in the image forming apparatus 100. To be specific, the temperature of the second-transfer device 20 easily increases, because the fixing device 24 generates heat. In particular, the temperature of the second-transfer device 20 easily increases during duplex printing, because a sheet S whose temperature has been increased due to fixing of an image to the front surface (first surface) thereof is transported again to the second-transfer device 20 via the transport section 50. Moreover, as described below, the second-transfer device 20 causes a second-transfer roller 21 to form a nip with the intermediate transfer belt 13, and a cleaning device 22 cleans the second-transfer roller 21. With such a structure, the distance from a nip point to a region to be cleaned along the outer periphery of the second-transfer roller 21 is short, and the temperature of the second-transfer device 20 easily increases, compared with, for example, a case where the second-transfer roller 21 is composed of a belt (not shown).

In the following description, the up-down direction of the image forming apparatus 100 illustrated in FIG. 1 (vertical direction) may be simply referred to as the "up-down direction". The upper side in the up-down direction in FIG. 1 may be simply referred to as the "upper side", and the lower side in the up-down direction may be simply referred to as the "lower side". The left-right direction of the image forming apparatus 100 illustrated in FIG. 1 may be simply referred to as the "width direction". The right side along the plane of FIG. 1 may be simply referred to as the "one side", and the left side along the plane of FIG. 1 may be simply referred to as "the other side". The depth direction of the image forming apparatus 100 with respect to the plane of FIG. 1 may be simply referred to as the "depth direction". The proximal side of the plane of FIG. 1 may be simply referred to as the "proximal side", and the distal side of the plane of FIG. 1 may be simply referred to as the "distal side" (see FIG. 2).

Second-Transfer Device 20

Figure 2:
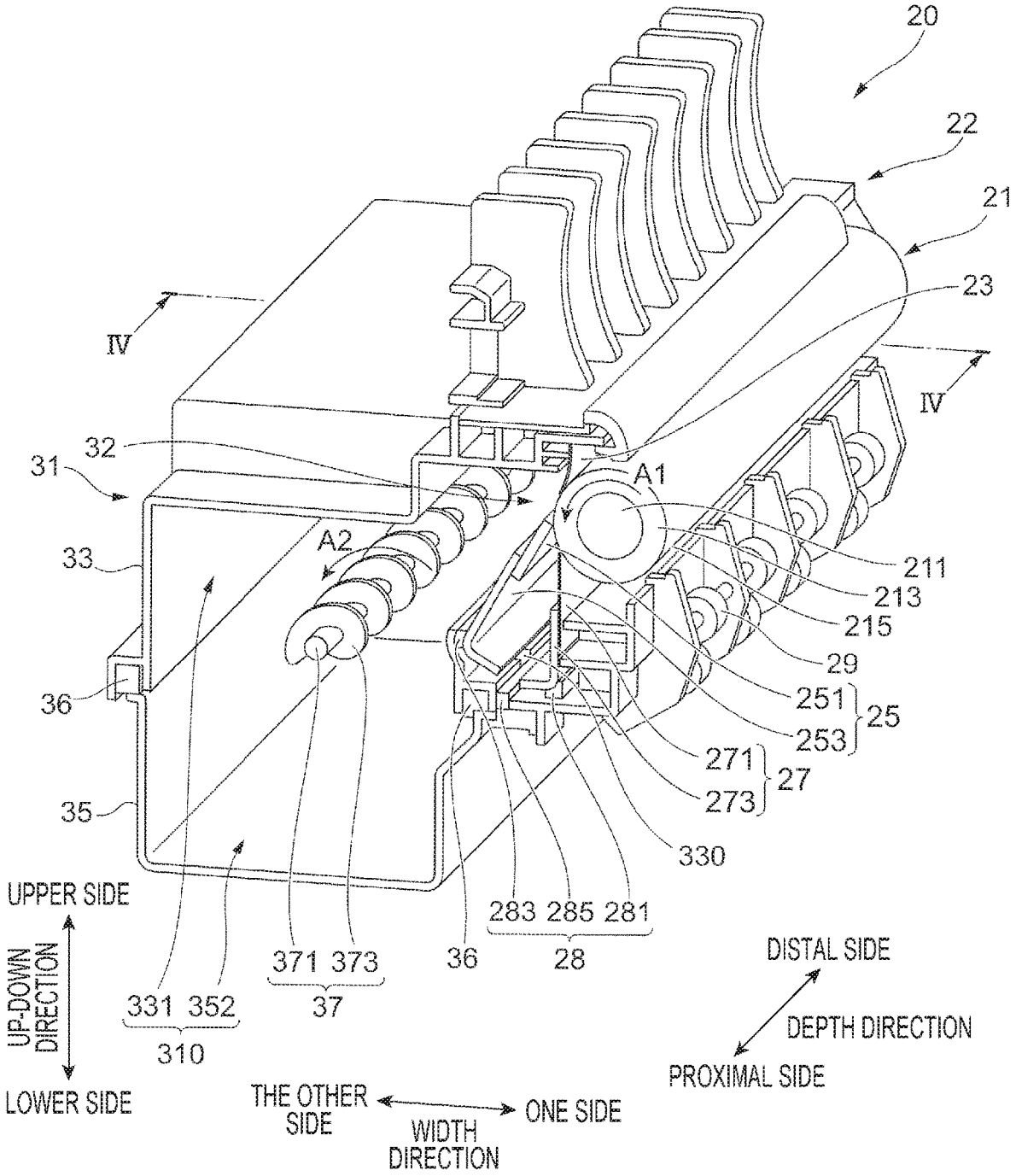
FIG. 2 is a perspective view of a second-transfer device according to the exemplary embodiment.

FIG. 2 is a perspective view of the second-transfer device 20 according to the present exemplary embodiment.

Figure 3:
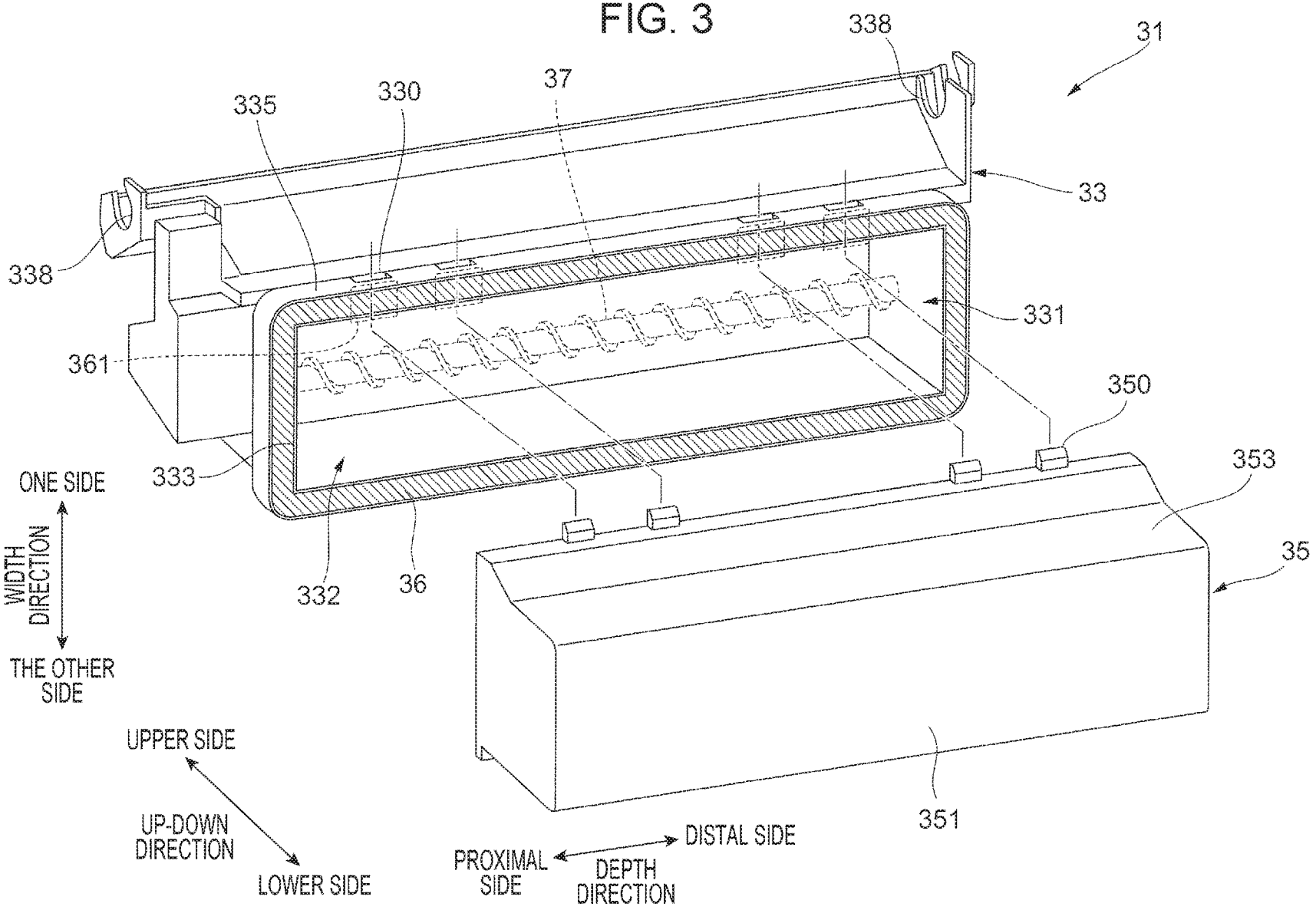
FIG. 3 is a perspective view of a housing body and a housing cover.

FIG. 3 is a perspective view of a housing body 33 and a housing cover 35. In FIG. 3, a part of the structure of a housing 31 is simplified for clarity.

Next, referring to FIGS. 1 to 3, the second-transfer device 20 according to the present exemplary embodiment will be described.

As illustrated in FIG. 2, the second-transfer device 20 includes the second-transfer roller 21 and the cleaning device 22. The second-transfer roller 21 rotates while being in contact with the outer peripheral surface of the intermediate transfer belt 13 (see FIG. 1) with a predetermined pressure. The cleaning device 22 cleans the outer peripheral surface of the second-transfer roller 21 by removing unwanted substances, such as toner and paper powder, that remain on and adheres to the outer peripheral surface.

The second-transfer roller 21 is a cylindrical member that includes at least an elastic layer and is rotatable in a predetermined direction (see arrow A1). The second-transfer roller 21 illustrated in FIG. 2 has a structure such that an elastic layer 213 and a surface layer 215 are formed in this order on the outer peripheral surface of an electroconductive roller base 211, which is made of a metal or the like. The elastic layer 213 is made of, for example, a material that includes an elastic material such as foamed polyurethane and an electroconductive material such as carbon black. The elastic layer 213, which is elastically deformable, reduces friction with an abutting member such as a scraper 27. The surface layer 215 is made of, for example, a synthetic resin such as a polyimide resin. The second-transfer roller 21 illustrated in FIG. 2 is capable of contacting and separating from the outer peripheral surface of the intermediate transfer belt 13 (see FIG. 1).

The cleaning device 22 includes a roller seal 23, a blade 25, and the scraper 27, which are located along the outer periphery of the second-transfer roller 21. The cleaning device 22 includes a housing seal 28, an auxiliary roller 29, the housing 31, and an auger 37. Hereafter, the constituent elements of the cleaning device 22 will be described.

The roller seal 23 is an elongated film-shaped member (plate-shaped member) whose longitudinal direction coincides with the direction in which the rotation shaft of the second-transfer roller 21 extends. One end (base) of the roller seal 23 in a direction (seal width direction) perpendicular to the longitudinal direction is supported by the housing 31. The other end (edge) of the roller seal 23 in the seal width direction is in contact with the outer peripheral surface of the second-transfer roller 21. The entirety of the roller seal 23 is disposed in a curved state. The roller seal 23 prevents leakage of unwanted substances, such as toner, collected by the blade 25 and the like, to the outside of the housing 31. That is, the roller seal 23 functions as a cover member that covers a cleaning opening 32 (described below) of the housing 31.

The blade 25 includes a blade body 251 and a blade holder 253 that holds the blade body 251. The blade body 251 is an elongated plate-shaped member whose longitudinal direction coincides with the direction in which the rotation shaft of the second-transfer roller 21 extends. One end (base) of the blade body 251 in a direction (blade width direction) perpendicular to the longitudinal direction is supported by the blade holder 253. The other end (edge) of the blade body 251 in the blade width direction is in contact with the outer peripheral surface of the second-transfer roller 21. The blade body 251 is in contact with the second-transfer roller 21 at a position on the downstream side of the roller seal 23 in the rotation direction of the second-transfer roller 21 (see arrow A1). The blade body 251 is made of an elastically deformable material such as a rubber or a synthetic resin. The blade holder 253 is made by bending a metal plate, having a substantially rectangular shape in plan view, to have an L-shaped cross section. The blade holder 253 is supported by the housing 31.

The blade 25 presses the edge of the blade body 251 against the outer peripheral surface of the second-transfer roller 21 and scrapes off toner that adheres to the second-transfer roller 21. The term "serape off" refers to removing substances that adhere to a surface of an object (such as the second-transfer roller 21) by causing a constituent member (such as the blade body 251) to contact the object. The blade 25 illustrated in FIG. 2 suppresses leakage of unwanted substances, such as collected toner, to the outside of the housing 31. That is, the blade 25 functions as a member that covers the cleaning opening 32 (described below) of the housing 31.

The scraper 27 includes a scraper body 271 and a scraper holder 273 that holds the scraper body 271. The scraper body 271 is an elongated plate-shaped member whose longitudinal direction coincides with the direction in which the rotation shaft of the second-transfer roller 21 extends. One end (base) of the scraper body 271 in a direction (scraper width direction) perpendicular to the longitudinal direction is supported by the scraper holder 273. The other end (edge) of the scraper body 271 in the scraper width direction is in contact with the outer peripheral surface of the second-transfer roller 21. The scraper body 271 is in contact with the second-transfer roller 21 at a position on the downstream side of the blade body 251 in the rotation direction of the second-transfer roller 21 (see arrow A1). The scraper body 271 is made of a metal or the like and is structured to have higher rigidity than the blade body 251. The scraper body 271 is made from a member (thin plate) whose thickness (plate thickness) is smaller than that of the blade body 251.

The scraper holder 273 is made by bending a metal plate, having a substantially rectangular shape in plan view, to have an L-shaped cross section. The scraper holder 273 is supported by the housing 31. The scraper holder 273 and the blade holder 253 are disposed in such a way that the longitudinal directions thereof coincide with the depth direction and the bent portions thereof are separated from the other. That is, the scraper holder 273 and the blade holder 253 are disposed in such a way that a channel R, which is a space interposed therebetween, is large.

The scraper 27 presses the edge of the scraper body 271 against the outer peripheral surface of the second-transfer roller 21 and scrapes off toner that adheres to the second-transfer roller 21. To be more specific, the scraper 27 removes unwanted substances that are not removed by the blade 25. Toner or the like that adheres to the second-transfer roller 21 may cause so-called "filming", which is a phenomenon in which the toner or the like forms a film that firmly adheres to the surface of the second-transfer roller 21. The scraper 27 scrapes the surface of the second-transfer roller 21 with the edge of the scraper body 271 to remove the film of toner formed by filming. The scraper 27 is pressed against the second-transfer roller 21 with a force (for example, a vertical load) that is larger than that of the blade 25. Because the blade 25 removes unwanted substances in advance, it is possible to reduce a force that presses the scraper 27, which is located at a position on the downstream side of the blade 25 in the rotation direction of the second-transfer roller 21 (see arrow A1), against the second-transfer roller 21.

The housing seal 28 is an elongated film-shaped member (plate-shaped member) whose longitudinal direction coincides with the direction in which the rotation shaft of the second-transfer roller 21 extends. The housing seal 28 is made of an elastically deformable material such as polyurethane, and seals the channel R that is interposed between the scraper holder 273 and the blade holder 253. The channel R is a space that is surrounded by the second-transfer roller 21, the blade 25, the scraper 27, the housing seal 28, and the like and that extends in the depth direction.

The housing seal 28 illustrated in FIG. 2 includes a scraper seal 281, a blade seal 283, and a middle seal 285. The scraper seal 281 is disposed between the scraper holder 273 and the housing body 33 (described below). The blade seal 283 is disposed between the blade holder 253 and the housing body 33. The middle seal 285 is disposed in a gap (recess) in the housing body 33.

The auxiliary roller 29 includes a plurality of roller pairs that are arranged in the depth direction. The auxiliary roller 29 guides a sheet S, which is supplied from the sheet feeder 40 (see FIG. 1), to a nip between the second-transfer roller 21 and the intermediate transfer belt 13 as the roller pairs rotate.

Next, referring to FIGS. 2 and 3, the housing 31 will be described. The housing 31 is a box-shaped structure whose longitudinal direction coincides with the direction in which the rotation shaft of the second-transfer roller 21 extends and that opens toward the second-transfer roller 21. To be more specific, the housing 31 has the cleaning opening 32 in a portion thereof that is on the upper side in the up-down direction and on one side in the width direction. The cleaning opening 32 is a rectangular opening that faces the outer peripheral surface of the second-transfer roller 21.

The housing 31 includes the housing body 33, the housing cover 35 that is fixed to the housing body 33, and a cover seal 36 that is interposed between the housing body 33 and the housing cover 35. The housing body 33 and the housing cover 35 constitute a waste toner container (waste toner box) 310. Toner (waste toner) collected by the blade 25 is accumulated in an inner space of the waste toner container 310, which is a space interposed between the housing body 33 and the housing cover 35.

As illustrated in FIG. 3, the housing body 33 contains the auger 37 and forms an upper space 331 in an upper part of the waste toner container 310. The housing body 33 has an opening 332 that is in a lower part thereof in the up-down direction and that has a substantially rectangular shape in a front view. The housing body 33 has a seal groove 333 that surrounds the opening 332. That is, the seal groove 333 is a ring-shaped groove that is formed along the opening 332. The housing body 33 has a plurality of (four) through-holes 330 that are formed in a body side surface 335 and that allow the inside and the outside of the waste toner container 310 to communicate with each other. Details of the through-holes 330 will be described below.

As illustrated in FIG. 3, the housing cover 35 includes a cover body 351 that covers the opening 332 of the housing body 33. The housing cover 35 is a box-shaped member whose side facing the housing body 33 is open. The housing cover 35 forms a lower space 352 (see FIG. 2) in a lower part of the waste toner container 310. The housing cover 35 includes a cover side surface 353, which is located on one side in the width direction in a state in which the housing cover 35 is fixed to the housing body 33, and a plurality of (four) cover tabs 350, which protrude toward the one side in the width direction from the cover side surface 353. The cover tabs 350 are inserted into the through-holes 330 of the housing body 33 and determine the position of the housing cover 35 relative to the housing body 33. The cover tabs 350 illustrated in FIG. 3 are each a plate-shaped member that is disposed in a direction such that a plate surface thereof intersects the up-down direction. The cover tabs 350 are arranged in the depth direction. Details of the structure of each of the cover tabs 350 will be described below.

As illustrated in FIG. 3, the cover seal 36 is a ring-shaped member that is made of an elastically deformable material such as polyurethane. The cover seal 36 illustrated in FIG. 3 is fitted into the seal groove 333, which has a ring-like shape. The cover seal 36 restricts passing of toner while allowing passing of a gas (air) therethrough. To be more specific, the cover seal 36 is a gas-permeable member that has a large number of small pores smaller than the particle size of toner. The cover seal 36 can be regarded as a mesh member. The cover seal 36 suppresses a flow of waste toner, which is contained in the waste toner container 310, to the outside.

As illustrated in FIG. 2, the auger 37 includes a rotation shaft 371 and a screw blade 373 disposed on the outer periphery of the rotation shaft 371. As the rotation shaft 371 of the auger 37 rotates (see arrow A2 in FIG. 2) by receiving a driving force from a driving source (not shown), the screw blade 373 transports toner contained in the waste toner container 310 in the depth direction. Thus, the auger 37 levels the waste toner contained in the waste toner container 310. That is, the auger 37 suppresses piling up of the waste toner in a partial region of the waste toner container 310. As the auger 37 receives a driving force from the driving source and rotates, the auger 37 accelerates the flow of a gas in the waste toner container 310. The flow of the gas in the waste toner container 310 will be described below.

Through-Hole 330

Figure 4:
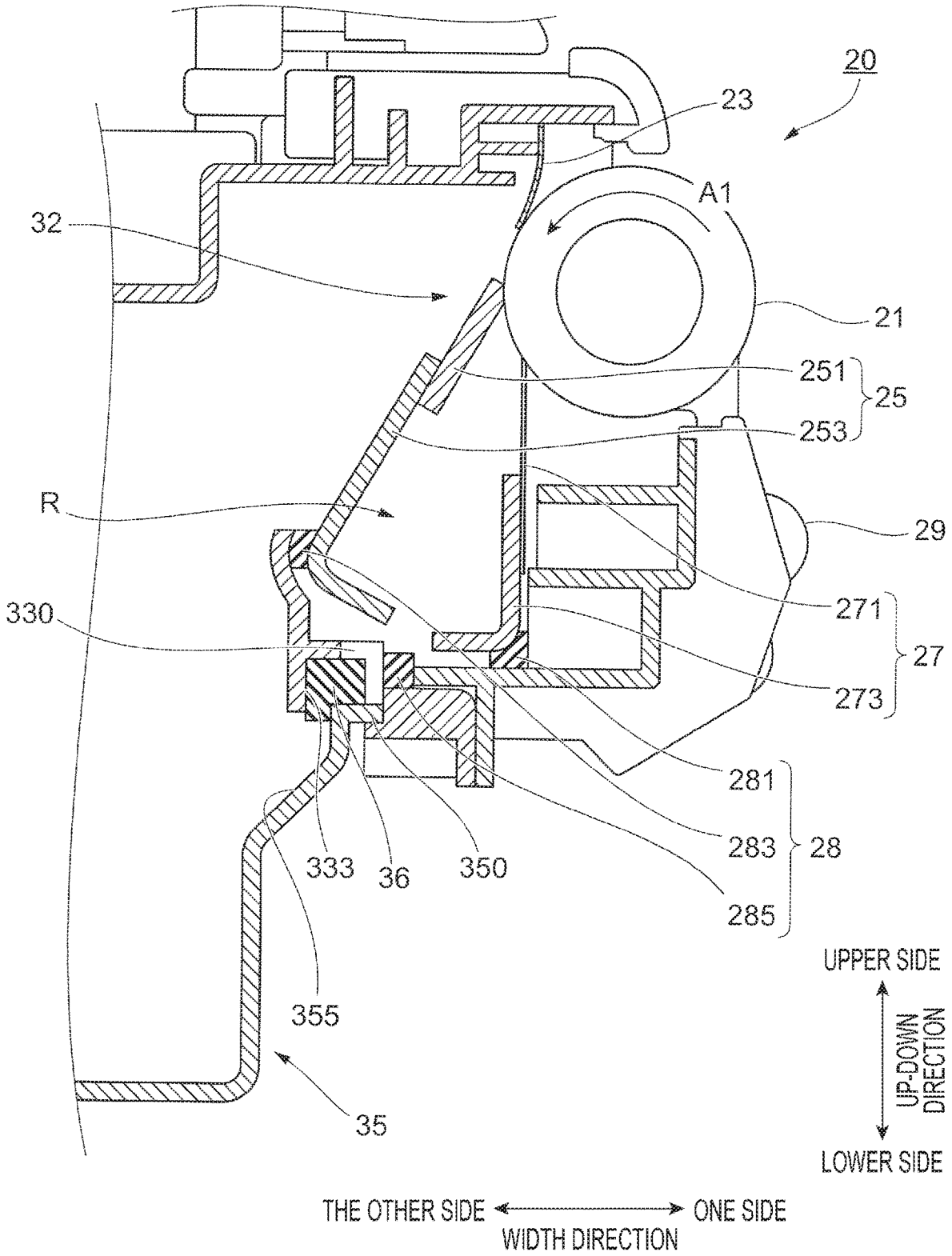
FIG. 4 is an enlarged sectional view of the second-transfer device, taken along line IV-IV of FIG. 2.

FIG. 4 is an enlarged sectional view of the second-transfer device 20, taken along line IV-IV in FIG. 2.

Figure 5:
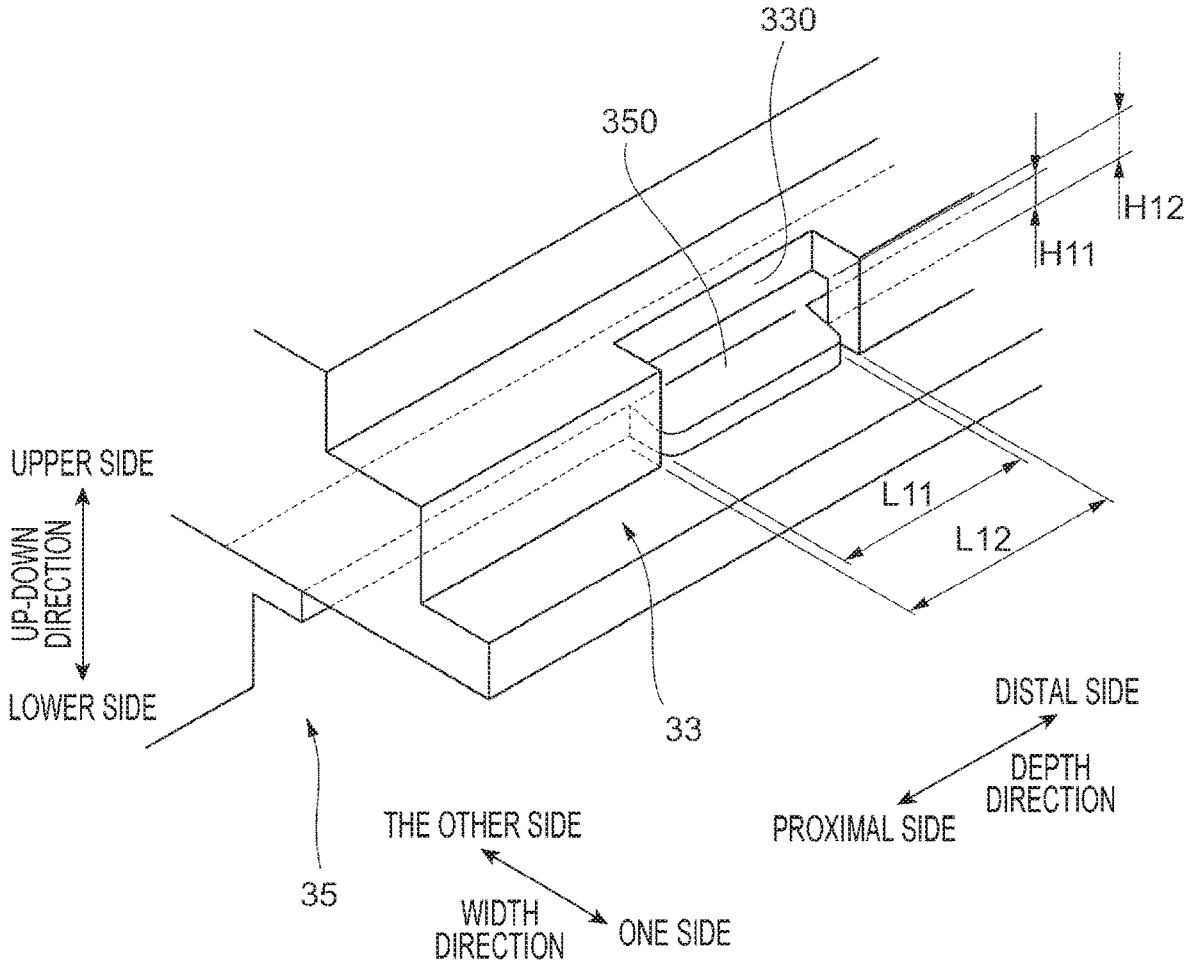
FIG. 5 illustrates the relationship between a through-hole and a cover tab.

FIG. 5 illustrates the relationship between one of the through-holes 330 and a corresponding one of the cover tabs 350.

Next, referring to FIGS. 3 to 5, how the through-holes 330 contribute to cooling of the scraper 27 will be described.

As described above, the scraper 27 is disposed in such a way that the edge of the scraper body 271 is in contact with the outer peripheral surface of the second-transfer roller 21. In this state, when the second-transfer device 20 operates and the second-transfer roller 21 rotates, the edge of the scraper body 271 rubs against the outer peripheral surface of the second-transfer roller 21 and generates frictional heat. The frictional heat increases the temperature of the scraper body 271 to, for example, 45° C. or higher. If the temperature of the scraper body 271 exceeds the melting temperature of toner, the toner melts and may firmly adhere to the scraper body 271. In the exemplary embodiment, the through-holes 330 are formed to suppress firm adhesion of toner due to increase in temperature of the scraper body 271.

As illustrated in FIG. 3, the through-holes 330, each of which is an opening having a substantially rectangular shape in a front view, are arranged in the depth direction. As illustrated in FIG. 4, each of the through-holes 330 is formed at a position where at least a part of the through-hole 330 faces the scraper 27. To be more specific, the through-hole 330 opens toward the scraper holder 273 of the scraper 27. The through-holes 330 allow a flow of a gas from the inside of the waste toner container 310 toward the scraper holder 273 of the scraper 27. As described below in details, although the internal pressure of the waste toner container 310 increases as the second-transfer roller 21 rotates, increase of the internal pressure of the waste toner container 310 is suppressed because the gas is released from the through-holes 330. Moreover, the scraper 27 is cooled due to the flow of the gas from the through-holes 330. To be more specific, it is possible to reduce the temperature of the scraper 27 by forming the through-holes 330 in the waste toner container 310, compared with a case where the through-holes 330 are not formed and the waste toner container 310 is tightly closed.

As illustrated in FIG. 3, the through-holes 330 extend through the body side surface 335 in the thickness direction and allow the body side surface 335 side and the inside of the seal groove 333 to communicate with each other. In other words, the through-holes 330 connect the inside and the outside of the body side surface 335. The cover seal 36 is disposed in the seal groove 333. A part of the cover seal 36 is exposed toward the inside of the waste toner container 310. With such a disposition, a gas that flows from the inside of the waste toner container 310 toward the through-holes 330 via the seal groove 333 passes through the cover seal 36. To be more specific, the gas from the inside of the waste toner container 310 passes through portions 361 of the cover seal 36 that face the through-holes 330. Thus, a flow of waste toner to the outside from the through-holes 330 is suppressed.

As illustrated in FIG. 4, each of the cover tabs 350 is inserted into a corresponding one of the through-holes 330 in order to fix the housing cover 35 to the housing body 33. The through-hole 330 illustrated in FIG. 4 has dimensions larger than those of the cover tab 350. Thus, in a state in which the cover tab 350 is inserted, the gas flows out from a gap formed between the cover tab 350 and the through-hole 330. To be specific, the length L12 of the through-hole 330 in the depth direction is larger than the length L11 of the cover tab 350 in the depth direction. Thus, in the state in which the cover tab 350 is inserted into the through-hole 330, a gap in the depth direction is formed. The length H12 of the through-hole 330 in the up-down direction is larger than the length H11 of the cover tab 350 in the up-down direction. Thus, in the state in which the cover tab 350 is inserted into the through-hole 330, a gap in the up-down direction is formed. Because the cover tab 350 have such dimensions, the gas flows out through a gap formed around the cover tab 350 in a state in which the cover tab 350 is inserted.

Flow of Gas

Figure 6:
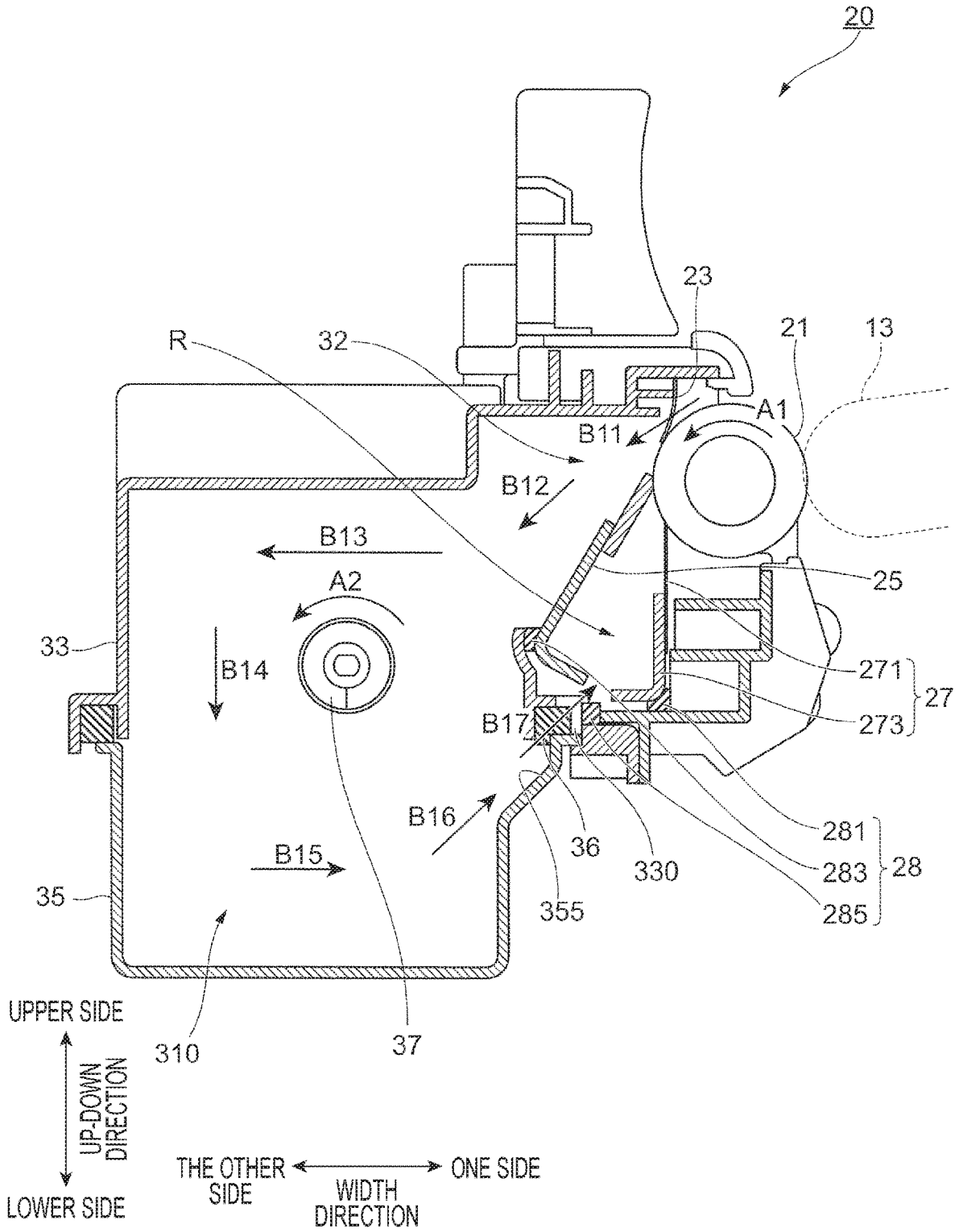
FIG. 6 illustrates the flow of a gas in a waste toner container.

FIG. 6 illustrates the flow of a gas in the waste toner container 310.

Figure 7:
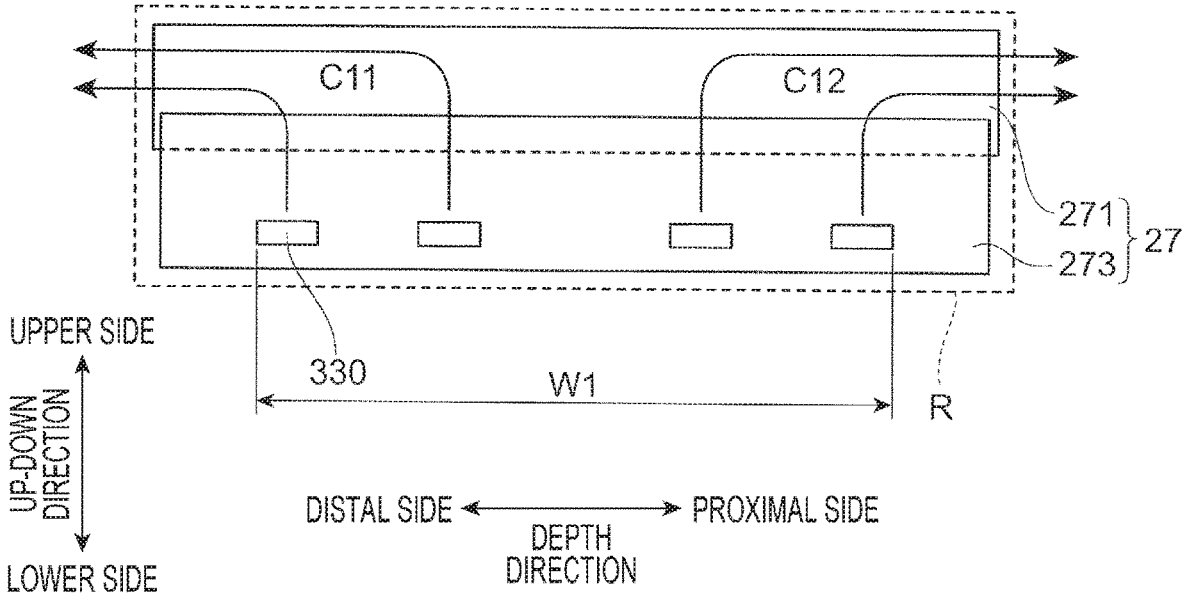
FIG. 7 illustrates the flow of a gas around a scraper.

FIG. 7 illustrates the flow of a gas around the scraper 27.

Figure 8:
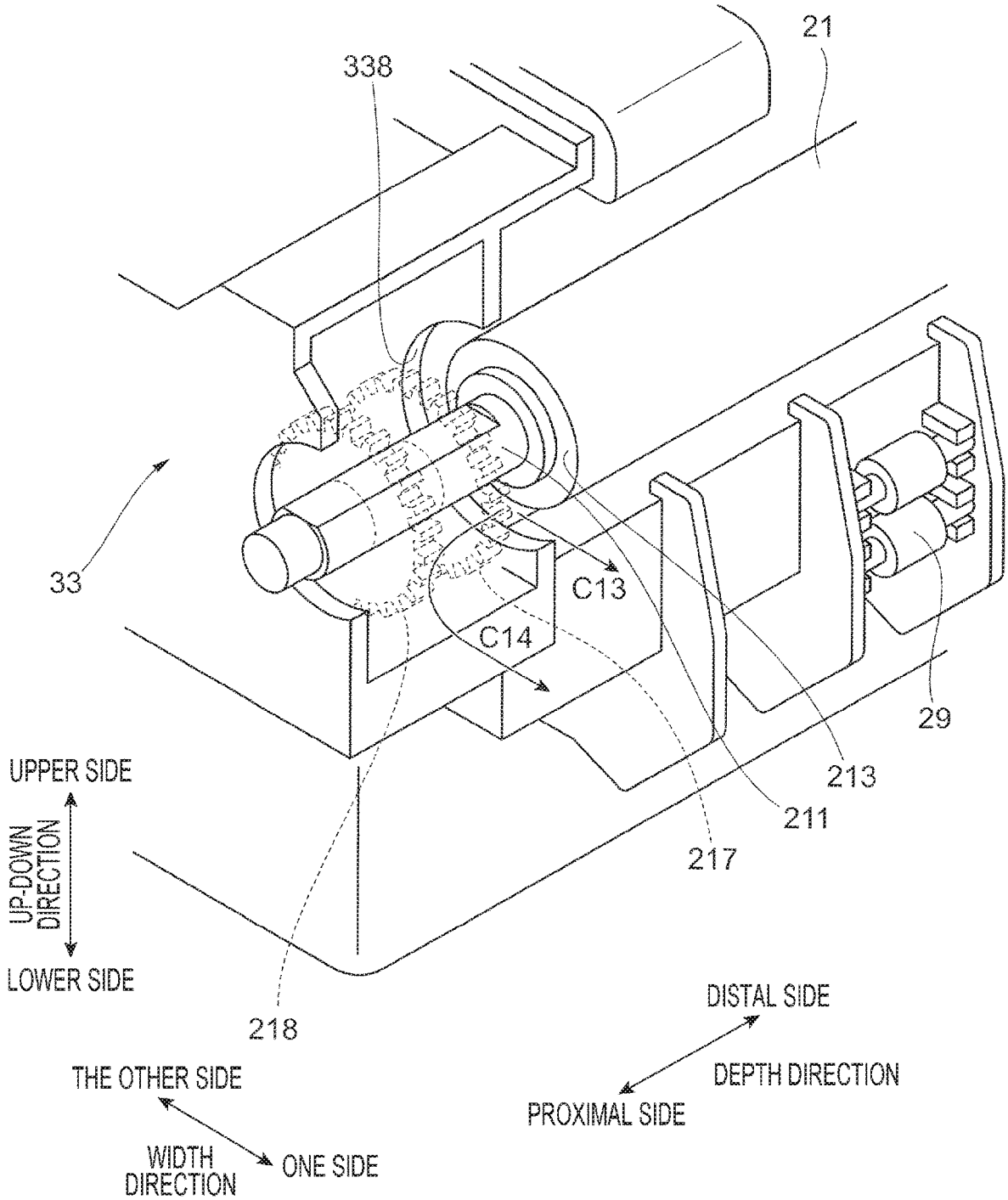
FIG. 8 illustrates the flow of a gas at an end portion of the second-transfer roller.

FIG. 8 illustrates the flow of a gas at an end portion of the second-transfer roller 21.

Next, referring to FIGS. 6 to 8, the flow of a gas in the second-transfer device 20 will be described.

As illustrated in FIG. 6, in a state in which the second-transfer roller 21 is in contact (forms a nip) with the outer peripheral surface of the intermediate transfer belt 13, the cleaning opening 32 of the waste toner container 310 is covered by the second-transfer roller 21, the roller seal 23, and the blade 25. That is, the waste toner container 310 is a closed space.

When the second-transfer roller 21 rotates, the edge of the roller seal 23 in the seal width direction may swing, and a gap may be temporarily formed between the roller seal 23 and the second-transfer roller 21. When a gap is formed, a gas flows into the waste toner container 310 (see arrow B11 in FIG. 6), and the internal pressure of the waste toner container 310 increases. The gas that has flowed into the waste toner container 310 moves along the blade 25 (see arrow B12 in FIG. 6), and circulates in the waste toner container 310 (see arrows B13 to B16 in FIG. 6). The gas in the waste toner container 310 flows out from the through-holes 330 (see arrow B17 in FIG. 6). The gas that has flowed out from the through-holes 330 as described above is blown against the scraper 27. Thus, the scraper 27, whose temperature has increased due to friction with the second-transfer roller 21, is cooled.

Here, the gas that has flowed out from the through-holes 330 flows into the channel R that is a space disposed among, that is, defined by the blade 25, the scraper 27, and the second-transfer roller 21. Accordingly, the gas that moves in the channel R cools the scraper 27 and the second-transfer roller 21.

As illustrated in FIG. 7, because the channel R extends in the depth direction, the gas that flows out from the through-holes 330 flows in the depth direction (see arrows C11 and C12 in FIG. 7). In this way, because the gas that flows out from the through-holes 330 moves in the channel R in the depth direction, the gas can cool an area that is large in the depth direction. For example, because the gas flows in the channel R in the depth direction, it is possible to cool an area that is larger than a region where the through-holes 330 are formed (see region W1 in FIG. 7).

Here, in the example illustrated in FIG. 7, the gas that moves in the channel R in the depth direction is released to the outside of the second-transfer device 20 from both ends of the channel R in the depth direction. Hereafter, referring to FIG. 8, the flow of the gas at both ends of the channel R will be described.

First, although description has been omitted, as illustrated in FIG. 8, a first drive gear 217 and a second drive gear 218 are disposed at a proximal end portion of the roller base 211 of the second-transfer roller 21 in the depth direction. As the first drive gear 217 and the second drive gear 218 receive a driving force from a driving source (not shown), the second-transfer roller 21 rotates. The housing body 33 has a cutout 338, in which the roller base 211 is disposed, at a position between the first drive gear 217 and the elastic layer 213 in the depth direction. Moreover, a gap is formed between the cutout 338 and the roller base 211. The gap is located at a proximal end portion of the channel R in the depth direction. The gas that moves in the channel R in the depth direction is released to the outside of the second-transfer device 20 through the gap (see arrows C13 and C14 in FIG. 8). Although detailed description is omitted, a cutout 338 is formed in the housing body 33 also at a distal end portion of the roller base 211 of the second-transfer roller 21 in the depth direction. A gas is released to the outside of the second-transfer device 20 through a gap between the cutout 338 and the roller base 211.

As illustrated in FIG. 6, the blade 25 is disposed at a position that covers the cleaning opening 32 of the waste toner container 310. The scraper 27 is located further toward the outside of the waste toner container 310 (toward the one side in the width direction) than the blade 25. Accordingly, the blade 25 suppresses a flow of a gas from the inside of the waste toner container 310 toward the scraper 27. Because the blade 25 covers the opening of the waste toner container 310, the internal pressure of the waste toner container 310 easily increases. As a result, the amount of gas that flows out from the through-holes 330 increases, and the scraper 27 is more efficiently cooled. As in the example illustrated in FIG. 6, by disposing the edge of the blade 25 so as to be in contact with the second-transfer roller 21, a flow of a gas from a space between the edge of the blade 25 and the second-transfer roller 21 is suppressed, and accordingly the amount of gas that passes through the through-holes 330 is increased. The through-hole 330 illustrated in FIG. 6 is configured to guide the gas toward the scraper 27 that is located at a position where the gas does not easily flow from the inside of the waste toner container 310.

Although description has been omitted, the housing cover 35 has an inclined surface 355 that is a part of an inner wall of the waste toner container 310 and that is located below the through-holes 330. The inclined surface 355 is inclined in a direction toward the one side in the width direction and the upper side in the up-down direction. The gas that flows from the other side toward the one side in the width direction (see arrow B15 in FIG. 6) moves along the inclined surface 355 toward the upper side in the up-down direction. Accordingly, the inclined surface 355 guides the gas flow (gas) toward the through-holes 330.

As illustrated in FIG. 6, the rotation direction of the auger 37 (see arrow A2 in FIG. 6) coincides with the direction in which the gas circulates in the waste toner container 310 (see arrows B13 to B16 in FIG. 6). In other words, the auger 37 has a function of guiding the gas toward the through-holes 330. Thus, the amount of gas that flows out from the through-holes 330 is increased, and accordingly the function of cooling the scraper 27 is improved. In addition, because waste toner in the waste toner container 310 is leveled as the auger 37 rotates, overflow of the toner from the through-holes 330 is suppressed.

Modifications

In the foregoing description of the exemplary embodiment, the through-holes 330 are formed in the cleaning device 22 that cleans the second-transfer roller 21. However, as long as the cleaning device 22 has a mechanism such that the edge thereof contacts the surface of a rotational body, an object to be cleaned by the cleaning device 22 is not limited to the second-transfer roller 21. For example, the structure described in the exemplary embodiment may be used in a cleaning device (not shown) that cleans the intermediate transfer belt 13, the photoconductor drum 12, or a transfer roller (not shown).

In the foregoing description of the exemplary embodiment, the cleaning device 22 includes the blade 25 and the scraper 27. However, the structure of the cleaning device 22 is not limited to this. For example, a cleaning device that does not have the blade 25 may cool the scraper 27 by using a gas that flows out from the through-holes 330. A cleaning device that does not have the scraper 27 may cool the blade 25 by using a gas that flows out from the through-holes 330.

In the foregoing description of the exemplary embodiment, the plurality of (four) through-holes 330, each of which has a substantially rectangular shape in a front view, are arranged in the depth direction. However, the number and the shape of the through-holes are not limited to these. To be more specific, the number and the shape are not limited, as long as the through-holes can guide a gas from the inside of the waste toner container 310 to the scraper 27 or the like.

In the foregoing description of the exemplary embodiment, the auger 37 rotates and guides the gas toward the through-hole 330. However, a member that guides the gas it not limited to an auger. To be more specific, any appropriate rotational body that rotates in the waste toner container 310, such as a roller or a motor, may be used.

In the foregoing description of the exemplary embodiment, the channel R is defined by the blade 25, the scraper 27, the second-transfer roller 21, and the like. However, members that define the channel R are not limited to these. To be more specific, as long as the channel R is a space that is defined by at least one of the blade 25 and the scraper 27, the space may be defined by both of the blade 25 and the scraper 27.

The cleaning device 22 in the foregoing description is an example of a cleaning device. The blade 25 and the scraper 27 are examples of a scraping portion. The blade 25 is an example of a first scraping member. The scraper 27 is an example of a second scraping member. The waste toner container 310 is an example of a container. The through-hole 330 is an example of a through-hole. The channel R is an example of a space. The cleaning opening 32 is an example of an opening region. The housing seal 28 is an example of a guide portion. The roller base 211 is an example of a rotation shaft. The housing body 33 is an example of a first member. The housing cover 35 is an example of a second member. The cover tab 350 is an example of a positioning tab. The cover seal 36 is an example of a sealing portion. The portion 361 that faces the through-hole 330 is an example of a portion that faces the through-hole. The inclined surface 355 and the auger 37 are examples of an acceleration mechanism. The inclined surface 355 is an example of a guide surface. The auger 37 is an example of another rotational body. The rotation shaft 371 is an example of another rotation shaft. The second-transfer roller 21 is an example of a rotational body.

The exemplary embodiment and the modifications described above may be used in combination, as appropriate.

The present disclosure is not limited to the exemplary embodiment described above and may be carried out in any forms within the spirit and scope of the present disclosure.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning device comprising:

a scraping portion whose edge is pressed against a rotational body to which toner adheres and that scrapes the toner off the rotational body; and a container that contains the toner that has been scraped off the rotational body, wherein the container has a through-hole that opens in a portion of the container facing the scraping portion and that allows a gas to flow from an inside of the container toward the scraping portion, wherein the scraping portion includes a first scraping member whose edge is pressed against the rotational body and that scrapes the toner off the rotational body, and a second scraping member that is disposed on a downstream side of the first scraping member in a rotation direction of the rotational body, whose edge is pressed against the rotational body, and that scrapes the toner off the rotational body, and wherein the through-hole allows the gas to flow toward the second scraping member.

2. The cleaning device according to claim 1, wherein the through-hole allows the gas to flow into a space that is interposed between the first scraping member and the second scraping member.

3. The cleaning device according to claim 2, wherein the first scraping member covers an opening region of the container and suppresses a flow of the gas from the inside of the container toward the second scraping member.

4. The cleaning device according to claim 3, further comprising:

a guide portion that guides the gas that has flowed toward the second scraping member in a direction in which a rotation shaft of the rotational body extends.

5. The cleaning device according to claim 3, further comprising:

a sealing portion that is interposed between the first member and the second member and that seals the container, wherein the sealing portion includes a portion that faces the through-hole, and wherein the portion that faces the through-hole allows a flow of the gas toward the scraping portion and suppresses a flow of the toner to an outside through the through-hole.

6. The cleaning device according to claim 5, wherein the container further comprises another through-hole, wherein the through-hole and the other through-hole are disposed each on one side of the in a width direction of the scraping portion.

7. The cleaning device according to claim 5, wherein the container further comprises another through-hole, wherein the through-hole and the other through-hole are arranged along the scraping portion.

8. The cleaning device according to claim 1, wherein the container includes an acceleration mechanism that is disposed in the container and that accelerates a flow of the gas toward the through-hole.

9. The cleaning device according to claim 8, wherein the acceleration mechanism is a guide surface that is a part of an inner surface of the container and that guides the gas toward the through-hole.

10. The cleaning device according to claim 8, wherein the acceleration mechanism is another rotational body that rotates in a direction of a flow of the gas in the container.

11. The cleaning device according to claim 10, wherein the other rotational body rotates around another rotation shaft that is parallel to the rotation shaft of the rotational body and transports the toner contained in the container in a direction in which the other rotation shaft extends.

12. A cleaning device comprising:

a scraping portion whose edge is pressed against a rotational body to which toner adheres and that scrapes the toner off the rotational body; and a container that contains the toner that has been scraped off the rotational body, wherein the container has an opening that faces a space at least a part of which is defined by the scraping portion.

13. A cleaning device comprising:

a scraping portion whose edge is pressed against a rotational body to which toner adheres and that scrapes the toner off the rotational body; and a container that contains the toner that has been scraped off the rotational body, wherein the container has a through-hole that opens in a portion of the container facing the scraping portion and that allows an inside and an outside of the container to communicate with each other.

14. A cleaning device comprising:

a scraping portion whose edge is pressed against a rotational body to which toner adheres and that scrapes the toner off the rotational body; and a container that contains the toner that has been scraped off the rotational body, wherein the container has a through-hole that opens in a portion of the container facing the scraping portion and that allows a gas to flow from an inside of the container toward the scraping portion, wherein the container includes a first member in which the through-hole is formed and a second member that is combined with and fixed to the first member, and wherein the second member includes a positioning tab whose end is inserted into the through-hole of the first member and that determines a position of the second member relative to the first member.

15. A cleaning device comprising:

a scraping portion whose edge is pressed against a rotational body to which toner adheres and that scrapes the toner off the rotational body; and a container that contains the toner that has been scraped off the rotational body, wherein the container has a through-hole that opens in a portion of the container facing the scraping portion and that allows a gas to flow from an inside of the container toward the scraping portion, wherein the cleaning device comprises multiple through-holes.

* * * * *